US006166284A

United States Patent [19]

Oelsner

[11] Patent Number: 6,166,284

[45] Date of Patent: Dec. 26, 2000

[54] CONTAINER FOR RADIOISOTOPES

[75] Inventor: Steve Oelsner, White Lake, Canada

[73] Assignee: MDS Nordion Inc., Kanata, Canada

[21] Appl. No.: 09/199,698

[22] Filed: Nov. 25, 1998

[51] Int. Cl.[7] ..... G21F 5/002; G21F 5/015

[52] U.S. Cl. ..... 588/16; 588/6; 588/8; 588/20; 976/DIG. 340; 976/DIG. 350; 976/DIG. 352

[58] Field of Search ..... 588/20, 6, 8, 16; 525/906; 976/DIG. 341, DIG. 350, DIG. 352, DIG. 353, DIG. 354; 252/625, 634, 644; 526/348, 335, 346, 396

[56] References Cited

U.S. PATENT DOCUMENTS

| | | | |
|---|---|---|---|
| 3,655,985 | 4/1972 | Brown et al. . | |
| 3,769,490 | 10/1973 | Czaplinski . | |
| 3,882,315 | 5/1975 | Soldan . | |
| 4,066,909 | 1/1978 | Bourdois et al. . | |
| 4,074,824 | 2/1978 | Kontes . | |
| 5,132,336 | 7/1992 | Layton et al. | 523/100 |
| 5,224,940 | 7/1993 | Dann et al. | 604/290 |
| 5,831,271 | 11/1998 | Okano et al. | 250/432 PD |

OTHER PUBLICATIONS

Scientific Polymer Products, Materials Safety Data Sheet, Jan., 1994.

Odian, Principles of Polymerization, John Wiley & Sons, Inc., 1991, p 32, 156–157.

Carson et al, Amer. Chem. Soc., Radiation Chemistry of Simulated Mo–99 Product, Aug., 1998.

*Primary Examiner*—Steven P. Griffin

*Assistant Examiner*—Elin Warn

*Attorney, Agent, or Firm*—Haynes & Boone, L.L.P.

[57] ABSTRACT

The present invention is directed to a material-radioactive isotope combination, comprising a container made from a material and a radioactive isotope solution. The container is useful for the storage, shipment, or storage and shipment of the radioactive isotope. Preferably the material is characterized by having a nearly full compliment of double carbon bonds so that little, or no hydrogen is produced by the material in the presence of the radioactive isotope. Furthermore, the preferred material exhibits greater mechanical strength than that of glass, resistance to a temperature range of from about −40° to about 160° C., chemical inertness; and radiation resistance. An example of such materials includes PSF (polysulfone) and PETG (polyethylene terephalate G copolymer) and the radioactive isotope, of the material-radioactive isotope combination are selected from, the group consisting of Mo-99, I-131, I-125. W-188 and Cr-51.

25 Claims, 1 Drawing Sheet

CONTAINER FOR RADIOISOTOPES

The present invention relates to a container suitable for the shipment and storage of radioactive isotopes. More specifically, this invention relates to a container comprised of at least one polymer material that is chemically inert, or compatible, with a radioactive isotope therein.

BACKGROUND OF THE INVENTION

The present invention relates to a container suitable for the shipment and storage of radioactive isotopes. More specifically, this invention relates to a container comprised of at least one polymer material that is chemically inert, or compatible, with a radioactive isotope therein.

Radioactive isotopes are generally transported within containers designed to ensure containment of the isotope in case of mechanical stress, and typically include shielding to reduce the level of radiation emitting from the container. For example, in U.S. Pat. No. 5,303836, there is disclosed a container suitable for the transport of highly enriched uranium comprising a heavy duty drum with a fiberboard and plywood insulation material, and an inner container made from stainless steel. U.S. Pat. No. 3,769,490 discloses the use of a leaded glass vessel for the transport of Tc-99m. The use of a shielded glass bottle for the storing or shipping radioisotopes is also disclosed in U.S. Pat. No. 3,655,985 and U.S. Pat. No. 4,074,824. U.S. Pat. No. 3,882,315 and U.S. Pat. No. 4,066,909 are also directed to containers for the storage and transport of radioactive isotopes and include embodiments to help absorb spillage, or ensure leak-tight coupling of a cover assembly, respectively. In many applications, radioactive isotopes are shipped in glass, however, in order to ensure that there is no breakage of the glass during shipment, the glass shipping vials are manufactured with very thick walls. As a result, part of the volume of shipping containers is used up by glass and not the desired radioisotope, which leads to increased shipping costs. Furthermore, from a customer standpoint, a major drawback arising from the use of glass is the potential for breakage as the shipping bottles may be subjected to significant mechanical stress at times.

Other material have been used for the shipment of radioisotopes. However, it has been observed that during the storage or shipment of radioactive isotopes, for example, molybdenum-99 (Mo-99), that precipitates of the isotope form over time. The formation of precipitate is especially evident when Mo-99 is shipped in NaOH, which is the preferred solution required by customers. The formation of precipitates concentrates the isotope and radiation within a small area of the container which may result in weakening of the container resulting in susceptibility to brittle fracture and failure of the container from impact. For example, Mo-99 solutions are typically transported within containers comprising high density polyethylene (HDPE). However, high activity or concentrations (~10 Ci/mL) of Mo-99, especially in a NaOH matrix, is not stable within HDPE bottles, and precipitates are routinely observed after a few hours following the dispensation of the isotope. A major problem with the precipitation of Mo-99 is that a high concentration of radioactivity accumulates within a small area of the bottle and this causes the structural integrity of the bottle to weaken and periodically fail during shipment, especially during extended shipment times, for example from North America to Japan, Europe or South America. HDPE containers containing Mo-99 have been known to fail after 48 hours shipping. Furthermore, customers do not like the black Mo-99 precipitate within shipping containers due to the additional processing required. A similar problem with other isotopes (such as W-188) in an NaOH matrix may also lead to precipitate formation within HDPE shipping containers.

In order to overcome this problem, Mo-99, is shipped with the addition of a stabilizer in order to help maintain the radioisotope in solution. For example, sodium hypochlorite (NaOCl) is normally added in order to slow down the reducing reaction which causes Mo-99 to precipitate, but some precipitate formation is still observed. The addition of sodium hypochlorite only helps delay the onset of Mo-99 precipitation.

Another problem related to the precipitation problem is gas pressure buildup in the head space at the top of the bottle. Hydrogen build up can occur with the shipment of radioactive isotopes of high activity. Examples of such isotopes include but are not limited to Mo-99, I-131, I-125, W-188 and Cr-51, however, other isotopes that are shipped in large volumes may also produce hydrogen gas over time. The production of hydrogen may be especially problematic with isotopes that do not comprise a "scavenger" for hydrogen, such as I-131 and I-125. Thus there is a need within the art for suitable container materials that are compatible with a radioisotope of interest, and that is suitable for the shipment and storage of radioactive isotopes.

This invention is directed towards providing a container suitable for the shipment and storage of radioactive isotopes, including isotopes wherein precipitation of the isotope may take place, for example Mo-99. In order for a material of a container to be useful for the shipment of isotopes it must be tough, durable, resistant to radiation and chemically compatible with the radioactive solution. Polymers are preferable to glass because they generally have greater mechanical robustness. Preferably, the material is also clear, transparent and mouldable and stable over a large temperature range. The material of the present invention may be used with any suitable container design, as would be known to one of skill in the art.

SUMMARY OF THE INVENTION

The present invention relates to a container suitable for the shipment and storage of radioactive isotopes. More specifically, this invention relates to a container comprised of at least one polymer material that is chemically inert, or compatible, with a radioactive isotope therein.

According to the present invention there is provided a material-radioactive isotope combination, comprising a container made from a polymer material and a radioactive isotope solution, said container useful for the storage, shipment, or storage and shipment of said radioactive isotope, said polymer material characterized by having a nearly full compliment of double carbon bonds so that little, or no hydrogen is produced by said polymer material in the presence of said radioactive isotope. Preferably, the polymer material exhibits:

i) greater resistance to brittle fracture and impact than that of glass;

ii) resistance to a temperature range of from about 0° to about 100° C.;

iii) chemical inertness; and iv) radiation resistance.

The present invention relates to the material-radioactive isotope combination as defined above, wherein said resistance to a temperature range of from about −40° to about 160° C. Preferably said polymer material is selected from the group consisting of PSF (polysulfone) and PETG (polyethylene terephthalate G copolymer). Furthermore, an aspect of the present invention is directed to the above material-radioactive isotope combination wherein said radioisotope is selected from the group consisting of Mo-99, I-131, I-125, W-188 and Cr-51. Preferably said radioisotope is Mo-99.

The present invention also embraces the material-radioactive isotope combination as defined above, wherein said Mo-99 is present as a solution comprising either NaOH, $NaNO_3$, $NH_4NO_3$, $NH_4OH$, or water. Where the solution comprises NaOH, then preferably there is from about 0.01 to about 2N of said NaOH in said solution. Furthermore, the solution may also comprise a stabilizer, wherein said stabilizer is an oxidation agent selected from the group consisting of $H_2O_2$ and NaOCl.

The present invention also embraces a method of storing or shipping a radioisotope comprising, selecting a container, adding said radioactive isotope to said container to make a container-radioisotope combination, and either storing, shipping, or storing and shipping, said container-radioisotope combination within said container for up to about 6 days, wherein said container comprises a polymer material characterized by having a nearly full compliment of double carbon bonds so that a minimal amount of $H_2$ is produced by said material in the presence of said radioactive isotope, and wherein little or no precipitation of said radioactive isotope is formed within said container.

The invention is furthermore directed to a method as defined above wherein said material exhibits:

i) greater resistance to brittle fracture and impact than that of glass;

ii) resistance to a temperature range of from about −40° to about 160° C.;

iii) chemical inertness;

iv) cleanliness; and v) radiation resistance.

Preferably said radioisotope within the method as defined above is selected from the group consisting of Mo-99, I-131, I-125, W-188 and Cr-51. Also, preferably, said polymer material is selected from the group consisting of PSF (polysulfone) and PETG (polyethylene terephthalate G copolymer).

This invention also relates to the method as defined above, wherein said radioisotope is Mo-99, and wherein said Mo-99 is present as a solution comprising either NaOH, $NaNO_3$, $NH_4NO_3$, $NH_4OH$, or water. If the solution comprises NaOH then preferably, there is from about 0.01 to about 2N of said NaOH in said solution. Furthermore, said solution may also comprise a stabilizer, said stabilizer being an oxidation agent. Preferably, said oxidation agent is selected from the group consisting of NaOCl and $H_2O_2$.

The present invention is directed to overcoming problems, that arise during the storage or shipment of radioactive isotopes, for example, molybdenum-99 (Mo-99). Such problems include the formation of either a precipitate, hydrogen, or the formation of both precipitate and hydrogen. By concentrating the isotope within a small area of the container, weakening the resistance of the container to brittle fracture and impact may result, causing the structural integrity of the bottle to weaken and periodically fail during shipment. Similarly, the formation of pressure buildup is not desired within the industry. In order to overcome these problems, this invention is directed at a container made from a polymer material that is chemically compatible with respect to the radioactive isotope contained therein. This invention also relates to the use of such a container-radioisotope combination for the shipment and storage of radioactive isotopes.

DESCRIPTION OF THE DRAWINGS

These and other features of the invention will become more apparent from the following description in which reference is made to the appended drawings wherein:

FIG. 1(A) is a picture of a shipping container, and FIG. 1(B) is a schematic of the same container. The size of the container, in this embodiment, conforms to the maximum inner dimension of a Type "B" shipping container insert, in order to ensure that as much volume of the container comprises the radioisotope of interest. However, it is to be understood that these figures show an example of one of many possible configurations of the container of the present invention, and this figure is not to limit the scope of the present invention in any manner.

DESCRIPTION OF PREFERRED EMBODIMENT

Figure 1A:
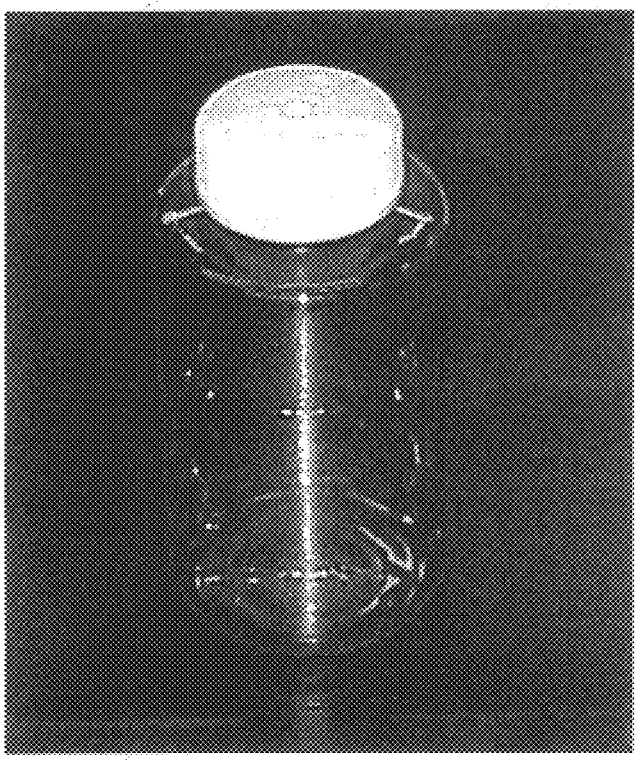
FIGS. 1(A) and 1(B) show an aspect of an embodiment of the present invention relating to a shipping container for the storage and transport of a range of radioactive isotopes.

The present invention relates to a container suitable for the shipment and storage of radioactive isotopes. More specifically, this invention relates to a container comprised of at least one polymer material that is chemically inert, or compatible, with a radioactive isotope therein.

In order for a material of a container to be useful for the shipment of an isotope the material must be tough, durable, resistant to radiation and chemically compatible with the radioactive solution. It is also desired that the material be clear, transparent and mouldable, exhibit stability over a large temperature, for example, but not limited to a range from about −10° to about 100° C., more preferably the range is from about −40° to about 160° C., have a desired amount of mechanical strength to withstand stresses encountered during shipping, be inert to a range of isotopes, and exhibit radiation resistance.

By radioactive isotope, as used herein, it is meant any radioactive isotope, for example, but not limited to Mo-99, I-125, I-131, W-188, or Cr-51 that may either lead to gas build up within a container, result in precipitate formation with a container under certain conditions, or lead to both hydrogen and precipitate formation. However, it is to be understood that any radioactive isotope may be stored or shipped within a container comprising the materials as disclosed in the present invention.

It has been observed that the onset of precipitation of a radioactive isotope, or the buildup of hydrogen gas, within a container can be delayed or prevented by selecting an appropriate polymer material that is inert or chemically combatable with the isotope, and manufacturing a container using this material. It is also considered within the scope of this present invention that a container may be comprised of more than one polymer material, however, it is preferred that at least one of the materials is inert or exhibits chemical compatibility with the isotope of interest. Therefore, this invention is directed to container-radioisotope combinations that are useful for the storage and shipment of a radioactive isotope, and preferably to help delay the onset of metal precipitate formation, or hydrogen gas formation.

Even though it has been determined that there is a benefit associated with the use of a container made with the polymer material according to the present invention with, for example, radioisotopes that tend to form metal precipitates, hydrogen gas, or both metal precipitates and hydrogen gas, it is to be understood that the polymer material of the container as disclosed herein may be used for the storage and transport of any desired isotope. Examples of isotopes that tend to form precipitates during storage or shipment include but are not limited to Mo-99, and under certain conditions W-188. Similarly, examples of isotopes that may result in hydrogen gas formation during storage or shipment include, but are not limited to, Mo-99, W-188, I-125, I-131, and Cr-51. It is also considered within the scope of the present invention that Mo-99 solutions that also contain a stabilizer such as, but not limited to, NaOCl and $H_2O_2$ may also be used. Furthermore, the storage and shipment of other radioactive isotopes may benefit from the container of the present invention even if precipitation, or hydrogen gas, is not formed to significant levels within other shipping containers. For example, the containers of the present invention exhibit a desirable resistance to brittle fracture and impact and yet are relatively thin walled, when compared with glass containers, thereby maximizing the amount of isotope shipped with a shipping container.

"Radiation resistance" generally refers to a property of a material used for a container for storing or shipping a radioisotope, that does not react with the radioactive isotope stored or transported within the container. Such a reaction may lead to precipitate formation, hydrogen evolution, or both precipitate and hydrogen formation, and weaken the material due to exposure of the material to an increased radiation dose, or it may include other undesired interactions between an isotope and container material that may affect the stability, or purity of the isotope. A material exhibits radiation resistance, if the material is not significantly affected during the course of the shipment or storage of the radioisotope, that is the material exhibits higher resistance to brittle fracture and impact than glass, or HDPE, for example. By brittle fracture it is meant the rapid rupture under tensile stress (i.e. shattering) of the material. Impact refers to the sudden application of a stress or force. A material also exhibits radiation resistance if the material is chemically inert with respect to the isotope placed within the container, in that radiation induced plastic degradation, hydrogen evolution, or both plastic degradation and hydrogen evolution are not significant when compared with materials such as HDPE or other single carbon-carbon bond polymers (see below). Furthermore, a material is radiation resistant if there is little or no leaching of plastic additives into solution which may result in contamination of the product. Radiation resistance also refers to the effect of a radioisotope on the resistance to brittle fracture and impact of the material upon exposure to the isotope. The resistance to brittle fracture and impact may be determined by examining the material for visible crack formation, drop testing the container (see Examples), or both, following exposure of the material to a radioisotope.

An acceptable material for use as a shipping container is one that is inert or chemically compatible with an isotope, and delays or prevents the onset of precipitation of a radioisotope, hydrogen formation, or both precipitation and hydrogen evolution. Since the radioisotope remains in solution, the container is not subject to localized exposure resulting from high doses of radiation which otherwise may lead to mechanical failure, and the container remains intact for the duration of the shipment.

In order to exemplify the present invention, tests were performed that compared the suitability of a range of materials for use as a container for the storage and shipment of Mo-99. The tested materials include PETG (polyethylene terephthalate G copolymer), HDPE (high density polyethylene), PSF (polysulfone), PS (polystyrene), FPE (fluoridated polyethylene) and glass.

As a result of the analysis presented below, it was found that several of these plastics, for example, PSF or PETG, either alone or in combination met all of the desired criteria. PETG may be used as a material suitable for shipping radioactive Mo-99, but as indicated in examples 2 and 3, low levels of precipitation in the presence of Molybdenum were observed upon irradiation. PETG also exhibits poorer temperature range characteristic (temperature maximum of 70° C.) when compared with PSF, however, PETG may be useable under certain conditions. Preferably the container comprises PSF.

Repeated experiments indicated that Mo-99, at radiation levels typically encountered during transport, did not react with PSF to form any significant amount of insoluble precipitate. Upon repeated drop testing, the bottles in contact with Mo-99 withstood vigorous stress, occasionally causing hairline fracturing of the surface after 4 to 5 days. Similar treatment of glass bottles resulted in failure on the first day. No cracks were observed during drop testing before this time. Fractures were observed after repeated testing after exposing the container to high level radiation doses for 6 days. This period of time is well in excess of a 48 hour shipment duration that is required to reach most customers, for example, those in Japan. Furthermore, minimum discolouration was observed of the container material that was in repeated contact with the radioactive isotope.

Figure 1B:
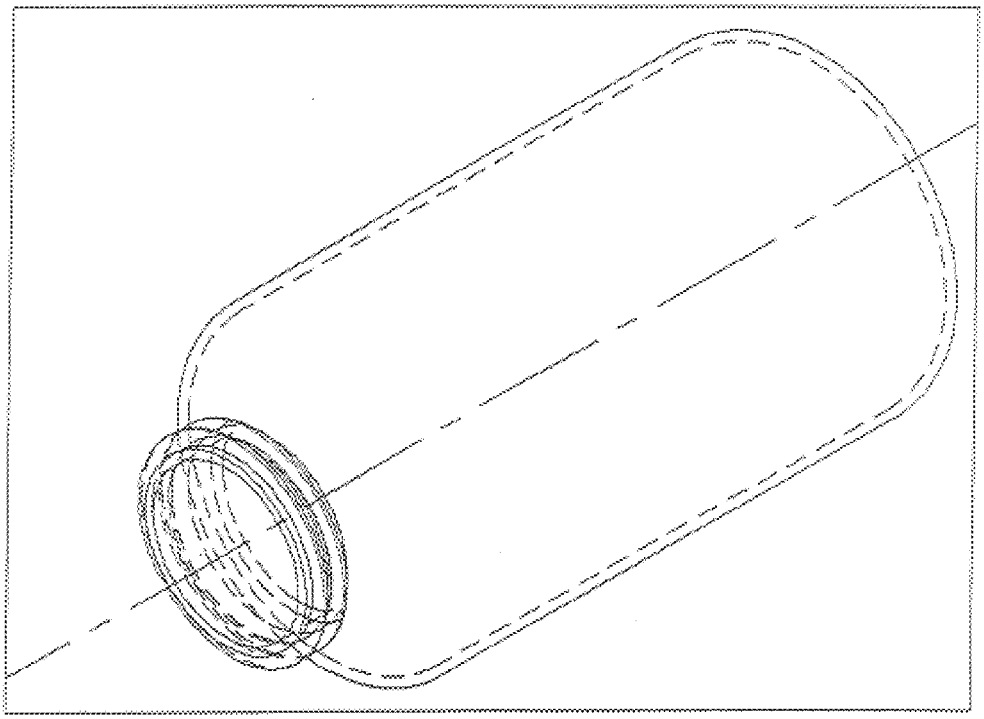

Preferably the container of the present invention is made of PSF, for example, but not limited to, UDEL POLYSULFONE P-1700. This plastic is transparent with a beige tinge. The container may be of suitable size for shipping purposes and may comprise a bottle, for example, but not limited to, a wide-mouth round bottle with an appropriate cap, for example, a 38 mm screw closure. The dimensions of a suitable bottle are provided below (see also FIG. 1), however, it is to be understood that these dimensions are not to be considered limiting in any manner:

| | inch | mm |
|---|---|---|
| Neck Interior Diameter | 1.13 ± 0.02 | 28.7 ± 0.5 |
| Height with Closure | 4.93 ± 0.04 | 125.2 ± 1.0 |
| Height without Closure | 4.77 ± 0.04 | 121.2 ± 1.0 |
| Diameter | 2.42 ± 0.02 | 61.5 ± 0.5 |
| Nominal Wall Thickness | 0.05 | 1.3 |
| Minimal Wall Thickness | 0.015 | 0.64 |
| Weight with Closure | 50 g | |

The storage and shipping container may also be comprised of a design as disclosed in U.S. Pat. No. 3,655,985 and U.S. Pat. No. 4,074,824.

Without wishing to be bound by theory, precipitate and hydrogen formation described in the examples below, for example within containers made from HDPE, may arise from radiation induced hydrolysis that occurs in a Mo-99 solution. The radiation-induced hydrolysis produces $H_2$ and $H_2O_2$ from the free radicals formed. Mo is originally in the $MoO_4^{-2}$ state and upon exposure to the reducing $H_2$ becomes $MoO_2$ and precipitates out of solution, however, if available, the $H_2O_2$ oxidizes it back into the $MoO_4^{-2}$ state. The $MoO_4^{-2} \longleftrightarrow MoO_2$ equilibrium may act as a scavenger for the $H_2$ and $O_2$ (as $H_2O_2$) produced as a result of radiation-induced hydrolysis (a similar mechanism has been proposed by S. D. Carson, M. J. McDonald, M. J. Garcia, Am Chem Soc August 1998 meeting).

The equilibrium outlined above may take place within a container comprised of a material that is chemically inert to these reactions, for example, but not limited to, containers made from glass or PSF. However, it is to be understood that there may be other materials which do not induce Mo-99 precipitation, for example, but not limited to, PETG. Furthermore, stabilizers may also be added to Mo-99 solutions in order to further minimize the formation of precipitate within a container comprising a material that exhibits the properties as described herein, for example PSF or PETG. Examples of suitable stabilizers include, but are not limited to NaOCl and $H_2O_2$.

Again, without wishing to be bound by theory, the reactions outlined above may account for the greater buildup of pressure within shipping containers comprising for example, I-131, than containers comprising Mo-99 solutions of similar activity, as there is no scavenger, such as Mo, within I-131 solutions. Furthermore, the radiation induced polymerization of the HDPE may cause the hydrogen saturated single carbon-carbon chains to form double bonds and give up $H_2$. This additional $H_2$ shifts the equilibrium in favour of reducing reactions and causes Mo-99 to precipitate out at the surface of the HDPE bottle.

Polysulphone has a nearly full compliment of double carbon bonds and therefore there is only a minimal availability of additional $H_2$ to give up thereby making the Mo-99 solution much more stable. Similarly, containers for the shipping of I-131 shipping should not be made from polyethylene as the additional $H_2$ produced would lead to an increase in pressure buildup. In this regard, for example, PSF containers for I-131 shipment would not produce much additional hydrogen. Similar properties of PETG also make this material suitable for the shipment of a range of isotopes.

Polysulphone has a number of characteristics that make it a suitable material for the purposes disclosed herein including radiation resistance and chemical resistance which contribute to PSF's ability to not induce Mo-99 precipitation. Furthermore, PSF exhibits a large useable temperature range, high strength, inertness, clarity, purity, and a higher resistance to brittle fracture and impact than glass or HDPE.

The present invention will be further illustrated in the following examples. However it is to be understood that these examples are for illustrative purposes only, and should not be used to limit the scope of the present invention in any manner.

EXAMPLES

Example 1: Precipitate Formation using HDPE

Molybdenum is typically prepared and transported as its sodium salt in solution. For this example, a sodium molybdate solution of 3 mg/ml was prepared with NaOH over a range of normalities from 0.2 to 2N. No stabilizers (e.g. sodium hypochlorite) were added to these solutions. The Mo-solutions were introduced into HDPE containers, and the containers and contents subjected to irradiation using an industrial gamma ray irradiator. A typical radiation dose to the container walls during a 2 day shipment is approximately 20 Mrad, provided at approximately 1.5 Mrad/hr over a 13 hour period. Therefore containers were subjected to this radiation level and the effect of the combination of radioisotope and HDPE was examined.

All containers with Sodium Molybdate/NaOH showed visible precipitate formation upon irradiation. Precipitate formation was observed over the range of NaOH solutions, from 0.2 to 2N, and demonstrates that precipitation within HDPE containers occurs over a large concentration of range of NaOH.

In order to determine if altering the salt of Mo had any effect on precipitate formation, other standard Mo-solutions were also prepared using 0.2N $NH_4NO_3$, $NH_4OH$, $NaNO_3$, and water. HDPE containers gamma irradiated as outlined above.

The Mo-$NH_4NO_3$, $NH_4OH$, $NaNO_3$ solutions, when placed within HDPE containers and exposed to 20 Mrad, showed no precipitate formation. Only Mo in water exhibited precipitate formation at 20 Mrad irradiation. However, containers that did not result in any precipitate formation (i.e. Mo-solutions in $NH_4NO_3$, $NH_4OH$ and $NaNO_3$) exhibited considerable amount of gas buildup, probably due to hydrogen liberation from the plastic.

Example 2: Comparison between containers made from HDPE, PETG and PSF and precipitate formation PETG, HDPE and PSF were examined with an inactive Mo solution (3 mg/ml Mo) in 0.2N NaOH. The Mo-solution was introduced into each container and the container then subjected to irradiation using an industrial gamma ray irradiator. The extent of any gray coloured precipitate, or other undesired properties, determined. A typical radiation dose to the container walls during a 2 day shipment is approximately 20 Mrad, therefore bottles were subjected to 1.5 Mrad/hr over a 13 hour period.

Following irradiation of PSF, PETG, and HDPE containers comprising the Mo solution, a gray-black precipitate was noted on the bottom of containers made from HDPE, and to a lesser degree the PETG. The formation of a precipitate with PETG-Mo was observed intermittently, in that not every irradiation exposure produced a precipitate. Only the PSF-Mo combination resulted in no precipitate formation.

After the irradiation was completed the precipitate noted within HDPE or PETG containers went back into solution. Without wishing to be bound by theory, this suggests that a radiation-catalyzed reaction causes precipitate formation with the Mo-solution when exposed to certain materials, and that once the radiation is removed, the radiation-catalyzed reaction is reversible.

Example 3: Effect of increased radiation dose on a range of plastics

A range of plastics were irradiated at a dose in excess of that received during a typical shipment. The radiation was supplied using a gamma ray irradiator as outlined in example 1, except that the irradiation dose was 70 Mrad (1.5 Mrad/hr over approximately 55 hours). The Mo-solution was the same as that used in example 2. The plastics tested were PSF, PETG, HDPE and FPE. Nylon caps were also tested to determine the effects of the matrix on this plastic under radiation exposure by inverting the bottles during irradiation.

Precipitate formation was observed in containers made from each plastic tested (HDPE-, FPE-, PETG- and PSF) when exposed to 70 Mrad, in the presence of the Mo solution. However, PETG and PSF had very little precipitate.

Inverted bottles exhibited more precipitate formation, indicating that nylon (as bottle caps) also forms a precipitate with Molybdate when irradiated.

Upon removal of the exposure to radiation, the Molybdate precipitate went back into solution. This was observed first within the PSF container containing Molybdate.

The containers were also examined for resistance to brittle fracture and impact using a drop test. The drop test consisted of dropping the bottles in the hot cell six times from a height of 0.5 m and four times from a height of 1 m. The tests were completed on days 2 and 4. Mo-99 was stored in the containers for the 2 to 4 day period, then the isotope was decanted and the test containers filled with 120 mL of water and any leakage observed. The containers were tested each day post irradiation until failure was observed. The earliest failure was day 4, which is well in excess of shipping times. Once a crack or leakage was observed the test was halted. It should be noted that this drop test is excessive and not representative of true shipping conditions. True shipping conditions would see the bottle encased in a shielded container with absorbent padding disallowing any movement of the bottle within the shield.

The mechanical characteristics of containers made from PSF were still intact as there was no evidence of failure until day 4, as indicated by visible stress-related cracks and drop testing. These results indicate that there may be a threshold amount of radiation, in terms of causing precipitation, for each plastic.

In separate experiments, there was no precipitate formation on any container comprising PSF when incubated with full activity Mo-99 (in 0.2N NaOH) for up to 4 days, however, HDPE containers exhibited precipitation within 4 hours.

Assessment of the TOC (total organic carbon, assessed using a TOC analyzer) within the PSF containers showed less than detection limit 5 ppm TOC when containers subjected to irradiation of 50 Mrad.

Example 4: PSF and glass at 100 Mrad

Glass and PSF containers were compared for resistance to precipitation in the presence of the Mo-solution defined in example 2, while receiving an radiation dose of 100 Mrad (within a Co-60 pool; 50 Mrad/hr for 2 hours).

As a result of this treatment, glass containers showed no precipitate formation, aside from sodium silicate crystals. PSF bottles showed some precipitate formation, similar with that observed at 70 Mrad as noted in example 3.

Example 5

PSF, PETG, FPE, HDPE, PS (polystyrene), plastic coated glass, and glass were evaluated for use as a possible shipping container and ranked based upon several criterion including:

1) chemical compatibility (as related to precipitate formation);
2) customer acceptance (general appearance and handling criteria);
3) temperature range (obtained from catalogues);
4) radiation resistance;
5) mechanical strength (as per manufacturers data sheets; resistance to brittle fracture and impact);
6) approved for food use (FDA); and
7) stability (long term storage).

The results of this analysis are presented in Table 1.

| Criteria | PSF | PET | PE(F) | HDPE | Coated glass | PS | Glass |
|---|---|---|---|---|---|---|---|
| Chemical compatibility | Good | Good | Poor | Poor | Varies | Good | Excellent |
| Customer Acceptance | Yes | Yes | Yes | Yes | — | — | Yes |
| Temperature range | Excellent | to 70° C. | Excellent | Excellent | Excellent | to 90° C. | Excellent |
| Radiation Resistance | Excellent | Excellent | Poor | Poor | Good | Excellent | Excellent |
| Mechanical Strength* | Excellent | Excellent | Poor | Poor | Good | Brittle | Brittle |
| Approved for food | Yes | Yes | ? | Yes | Yes | Yes | Yes |
| Stability | Excellent | Excellent | Poor | Poor | Good/ Excellent | Excellent | Excellent |

*resistance to brittle fracture and impact

Of these features PSF stood out as being the best of combined characteristics.

Example 6: Addition of stabilizer to sodium Mo-solutions

Addition of a stabilizer such as NaOCl or $H_2O_2$ are known to reduce the onset of precipitation within HDPE, therefore the effect of a stabilizer, NaOCl (0.4%), on the onset of precipitation from Sodium-Molybdate/NaOH (0.2N) solutions was examined using PSF and HDPE containers. The containers were irradiated as outlined in example 2 and examined form precipitate formation.

The addition of NaOCl prevented precipitate formation in containers made from HDPE for at least triple the time during exposure to 20 Mrad, compared with Mo-solutions lacking the stabilizer. However, PSF containers comprising Sodium-Molybdate, without NaOCl, were at least 6 times more effective than HDPE at not precipitating, based upon the time required for precipitate formation. That is, even in the absence of a stabilizer, PSF was more effective in delaying the onset of precipitate formation of sodium-molybdate/NaOH, than HDPE comprising sodium-molybdate/NaOH along with a stabilizer (NaOCl).

PSF and HDPE containers were also tested using Mo-99 in the absence of NaOCl. Containers made from HDPE and lacking NaOCl, exhibited precipitate formation at 3.5 h. However, there was no evidence of Mo-99 precipitation in any PSF bottle at the 48 h mark.

These results indicate that containers made from PSF delay the onset of precipitate formation by at least 10 times, when compared with containers made from HDPE. Furthermore, containers made from PSF comprising sodium Mo-99, and lacking any NaOCl still delayed precipitate formation by at least 10 times.

The resistance to brittle fracture and impact of PSF lasted at least 4 days post the start of irradiation (see also Example 3).

Collectively these results demonstrate that Mo-99, the presence or absence of a stabilizer, in PSF remains stable significantly longer than in HDPE, and that the mechanical strength (resistance to brittle fracture and impact) of the PSF container is maintained for average 5 days.

Furthermore, radiochemical analysis of the Mo-99 product met specifications with respect to radiochemical purity (>95% radiochemical purity) indicating that the product was within specifications.

Example 7: Mechanical strength of containers in the presence of Mo-99

Containers made from PSF containing 17 Ci/mL Mo-99 (0.2N NaOH) and comprising from about 700 Ci to about 2800 Ci Mo-99 were incubated for up to 5 days and the mechanical strength of the container determined during this period of time following a drop test protocol outlined below.

The drop test consisted of dropping the containers in a hot cell six times from a height of 0.5 m and four times from a height of 1 m. The tests were completed on days 4 and 5. Prior to the drop test, the Mo-99 was removed from the containers and the containers filled with 120 mL of water to observe any leaks. This drop test is excessive and is not representative of true shipping conditions. True shipping conditions would see the bottle encased in a shielded container with absorbent padding disallowing any movement of the bottle within the shield. These results are to be compared with reports of the failure of HDPE containers containing Mo-99 after 48 hours shipping times.

The PSF container exhibited cracks after repeated drop testing at the 6 day mark of the container comprising Mo-99 and well in excess of the 48 hour period required for a shipment to reach Japan. Drop testing six times at a height of 0.5 m on both days 0, 2 and 4 showed no observable detrimental effects. Similarly, a drop test, from a im height and repeated four times, on day 4 produced no visible mechanical damage to the container. However, bottle damage was observed on drop #3 of the 1 m test on day 6. Uniform discoloration of the PSF bottles was present at the product level.

All citations are incorporated by reference.

The present invention has been described with regard to preferred embodiments. However, it will be obvious to persons skilled in the art that a number of variations and modifications can be made without departing from the scope of the invention as described herein.

The embodiments of the invention in which an exclusive property of privilege is claimed are defined as follows:

1. A material-radioactive isotope combination, comprising a container made from a polymer material and a radioactive isotope solution within said container, said container useful for the storage, shipment, or storage and shipment of said radioactive isotope, said polymer material having a greater compliment of double carbon bonds than that of high density polyethylene.

2. The material-radioactive isotope combination of claim 1, wherein said polymer material exhibits properties of:

i) greater resistance to brittle fracture and impact than that of glass;

ii) resistance to a temperature range of from about −40° to about 160° C.;

iii) chemical inertness; and iv) radiation resistance.

3. The material-radioactive isotope combination of claim 2 wherein said resistance to temperature range is from about 0° to about 100° C.

4. The material-radioactive isotope combination of claim 2 wherein said polymer material is PSF (polysulfone).

5. The material-radioactive isotope combination of claim 2 wherein said polymer material is PETG (polyethylene terephthalate G copolymer).

6. The material-radioactive isotope combination of claim 2 wherein said polymer material is a combination of PSF and PETG.

7. The material-radioactive isotope combination of claim 4, wherein said radioactive isotope is selected from the group consisting of Mo-99, I-131, I-125, W-188 and Cr-51.

8. The material-radioactive isotope combination of claim 7 wherein said radioactive isotope is Mo-99.

9. The material-radioactive isotope combination of claim 8 wherein said Mo-99 is present as a solution comprising either NaOH, $NaNO_3$, $NH_4NO_3$, $NH_4OH$ or water.

10. The material-radioactive isotope combination of claim 9, wherein there is from about 0.01 to about 2N of said NaOH in said solution.

11. The material-radioactive isotope combination of claim 10 wherein said solution also comprises a stabilizer.

12. The material-radioactive isotope combination of claim 11, wherein said stabilizer is an oxidation agent selected from the group consisting of $H_2O_2$ and NaOCl.

13. A material-radioactive isotope combination for storing or transporting a radioactive isotope, comprising a container made from a polymer material and a radioactive isotope solution within said container, said container useful for the storage, shipment, or storage and shipment of said radioactive isotope, said polymer material comprising the following properties:

i) a greater compliment of double carbon bonds than that of high density polyethylene;

ii) greater resistance to brittle fracture and impact than that of glass;

iii) resistance to a temperature range of from about −40° to about 160° C.;

iv) chemical inertness; and v) radiation resistance;

so that the onset of precipitation of said radioisotope, or hydrogen evolution, or both precipitation and hydrogen evolution, within said container is reduced, when compared with hydrogen evolution using HDPE, or eliminated.

14. A method of storing or shipping a radioactive isotope comprising, selecting a container, adding said radioactive isotope to said container to make a container-radioactive isotope combination, and either storing, shipping, or storing and shipping, said container-radioactive isotope combination within said container for up to about 6 days, wherein said container comprises a polymer material having a greater compliment of double carbon bonds than that of high density polyethylene.

15. The method of claim 14, wherein said material exhibits properties of:

i) greater resistance to brittle fracture and impact than that of glass;

ii) resistance to a temperature range of from about −40° to about 160° C.;

iii) chemical inertness; and v) radiation resistance.

16. The method of claim 15 wherein said resistance to temperature range is from about −0° to about 100° C.

17. The method of claim 16, wherein said radioactive isotope is selected from the group consisting of Mo-99, I-131, I-125, W-188, Cr-51.

18. The method of claim 17, wherein said material is selected from the group consisting of PSF (polysulfone) or PETG (polyethylene terephthalate G copolymer).

19. The method of claim 18, wherein said radioactive isotope is Mo-99.

20. The method of claim 19, wherein said Mo-99 is present as a solution comprising either NaOH, $NaNO_3$, $NaNO_3$, $NH_4NO_3$, $NH_4OH$, or water.

21. The method of claim 20, wherein there is from about 0.01 to about 2N of said NaOH in said solution.

22. The method of claim 21, wherein said solution also comprises a stabilizer.

23. The method of claim 22, wherein said stabilizer is an oxidation agent selected from the group consisting of $H_2O_2$ and NaOCl.

24. A material-radioactive isotope combination, comprising a container made from a polymer material and a radioactive isotope solution within said container, said container useful for the storage, shipment, or storage and shipment of said radioactive isotope, said polymer material selected from the group consisting of polyethylene terephthalate G copolymer (PETG), polysulfone (PSF), and a combination of PETG and PSF.

25. A method of storing or shipping a radioactive isotope comprising, selecting a container, adding said radioactive isotope to said container to make a container-radioactive isotope combination, and either storing, shipping, or storing and shipping, said container-radioactive isotope combination within said container for up to about 6 days, wherein said container comprises a polymer material selected from the group consisting of polyethylene terephthalate G copolymer (PETG), polysulfone (PSF) and a combination of PETG and PSF.

* * * * *

UNITED STATES PATENT AND TRADEMARK OFFICE

CERTIFICATE OF CORRECTION

PATENT NO. : 6,166,284
DATED : December 26, 2000
INVENTOR(S) : Steve Oelsner

It is certified that error appears in the above-identified patent and that said Letters Patent is hereby corrected as shown below:

Title page,
Item [57], ABSTRACT,
Line 16, insert -- but not limited to, -- before "the group"

Column 13,
Line 11, change "-0º" to -- 0º --

Signed and Sealed this

Twenty-first Day of January, 2003

JAMES E. ROGAN
*Director of the United States Patent and Trademark Office*